US008881428B2

(12) United States Patent
Mackey et al.

(10) Patent No.: US 8,881,428 B2
(45) Date of Patent: Nov. 11, 2014

(54) SOLE ASSEMBLY FOR ARTICLE OF FOOTWEAR WITH PLURAL CUSHIONING MEMBERS

(75) Inventors: Daniel T. Mackey, Portland, OR (US); Martine I. V. Mientjes, Beaverton, OR (US); Erez Morag, Lake Oswego, OR (US); Ty A. Ransom, Portland, OR (US); Blake Rhulen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 780 days.

(21) Appl. No.: 12/874,747

(22) Filed: Sep. 2, 2010

(65) Prior Publication Data

US 2012/0055041 A1 Mar. 8, 2012

(51) Int. Cl.

| | |
|---|---|
| ***A43B 13/12*** | (2006.01) |
| ***A43B 13/18*** | (2006.01) |
| ***A43B 7/14*** | (2006.01) |
| ***A43B 13/16*** | (2006.01) |

(52) U.S. Cl.

CPC ..... *A43B 7/141* (2013.01); *A43B 13/188* (2013.01); *A43B 7/1445* (2013.01); *A43B 7/1435* (2013.01); *A43B 13/16* (2013.01); *A43B 7/1425* (2013.01); *A43B 7/148* (2013.01)

USPC ..... 36/28; 36/30 R; 36/35 R; 36/103

(58) Field of Classification Search

CPC ..... A43B 17/02; A43B 17/023; A43B 17/03; A43B 17/026; A43B 7/1425; A43B 7/1435; A43B 7/1445; A43B 7/1465; A43B 13/16; A43B 13/188

USPC ..... 36/28, 35 R, 37, 25 R, 103, 30 R, 142, 36/143, 31

See application file for complete search history.

(56) References Cited

U.S. PATENT DOCUMENTS

| | | | |
|---|---|---|---|
| 604,044 | A | 5/1898 | Hibbert |
| 979,243 | A | 12/1910 | Anderson |

(Continued)

FOREIGN PATENT DOCUMENTS

| | | |
|---|---|---|
| GB | 543053 | 2/1942 |
| WO | WO 2009/069926 | 6/2009 |

OTHER PUBLICATIONS

International Search Report dated Oct. 31, 2011, International Application No. PCT/US2011/040865, International Filing Date: Jun. 17, 2011.

(Continued)

*Primary Examiner* — Jila M Mohandesi

(74) *Attorney, Agent, or Firm* — Plumsea Law Group, LLC

(57) ABSTRACT

An article of footwear includes a sole assembly defining a base support plane. The sole assembly also includes a cushioning assembly with a first end and a second end. The cushioning assembly includes a first cushioning member and a second cushioning member. The first cushioning member includes a first overlapping surface, and the second cushioning member includes a second overlapping surface. The first and second overlapping surfaces overlap each other over the base support plane and each slopes at a positive acute angle relative to the base support plane. The first cushioning member is thicker than the second cushioning member adjacent the first end of the cushioning assembly, and the second cushioning member is thicker than the first cushioning member adjacent the second end of the cushioning assembly. The first cushioning member has a resistance to resilient deformation less than that of the second cushioning member.

22 Claims, 3 Drawing Sheets

(56) References Cited

U.S. PATENT DOCUMENTS

| | | | | | |
|---|---|---|---|---|---|
| 1,553,874 | A | | 4/1923 | Nivens | |
| 3,021,846 | A | | 2/1962 | Scholl | |
| 4,280,488 | A | | 7/1981 | Polsky et al. | |
| 4,294,238 | A | | 10/1981 | Woodford | |
| 4,316,332 | A | * | 2/1982 | Giese et al. | 36/28 |
| 4,358,902 | A | | 11/1982 | Cole et al. | |
| 4,367,885 | A | | 1/1983 | Ramer | |
| 4,506,462 | A | * | 3/1985 | Cavanagh | 36/92 |
| 4,638,577 | A | | 1/1987 | Riggs | |
| 4,821,431 | A | | 4/1989 | Rieffel | |
| 4,878,504 | A | | 11/1989 | Nelson | |
| 5,042,175 | A | | 8/1991 | Ronen et al. | |
| 5,090,138 | A | | 2/1992 | Borden | |
| 5,125,171 | A | | 6/1992 | Stewart | |
| 5,224,925 | A | | 7/1993 | Varn | |
| 5,256,119 | A | | 10/1993 | Tudor | |
| 5,375,346 | A | | 12/1994 | Cole et al. | |
| 5,475,935 | A | | 12/1995 | Frost | |
| 5,564,989 | A | | 10/1996 | Larsen | |
| 5,579,591 | A | * | 12/1996 | Kousaka et al. | 36/31 |
| 5,592,757 | A | * | 1/1997 | Jackinsky | 36/114 |
| 5,621,985 | A | | 4/1997 | Frost | |
| 5,727,335 | A | * | 3/1998 | Kousaka et al. | 36/31 |
| 5,833,640 | A | | 11/1998 | Vazquez, Jr. et al. | |
| 5,842,291 | A | | 12/1998 | Schmidt et al. | |
| 5,921,009 | A | | 7/1999 | Hice | |
| 6,115,943 | A | | 9/2000 | Gyr | |
| 6,301,807 | B1 | | 10/2001 | Gardiner | |
| 6,349,487 | B1 | | 2/2002 | Hice | |
| 6,550,160 | B2 | | 4/2003 | Miller, II | |
| 6,725,572 | B1 | * | 4/2004 | Krstic | 36/25 R |
| 6,732,456 | B2 | | 5/2004 | Hussain | |
| 6,966,130 | B2 | | 11/2005 | Meschan | |
| 6,978,684 | B2 | | 12/2005 | Nurse | |
| 7,530,181 | B2 | * | 5/2009 | Joynt et al. | 36/25 R |
| 7,644,521 | B2 | | 1/2010 | McCarron | |
| 2002/0056209 | A1 | | 5/2002 | Clough et al. | |
| 2004/0064973 | A1 | * | 4/2004 | Talbott | 36/25 R |
| 2005/0137511 | A1 | | 6/2005 | Bailar | |
| 2006/0048414 | A1 | * | 3/2006 | Takada | 36/93 |
| 2007/0107258 | A1 | * | 5/2007 | Umezawa et al. | 36/30 R |
| 2009/0234254 | A1 | | 9/2009 | Bar-Haim et al. | |

OTHER PUBLICATIONS

Written Opinion dated Oct. 31, 2011, International Application No. PCT/US2011/040865, International Filing Date: Jun. 17, 2011.

* cited by examiner

SOLE ASSEMBLY FOR ARTICLE OF FOOTWEAR WITH PLURAL CUSHIONING MEMBERS

FIELD

The present disclosure relates to an article of footwear and, more particularly, relates to a sole assembly for an article of footwear with plural cushioning members.

BACKGROUND

Articles of footwear can include an upper and a sole assembly. The upper can include layers or sections of material that wrap about and cover a substantial portion of the wearer's foot and ankle. The upper can also include laces, straps, or the like for securing the footwear to the wearer's foot. The sole assembly can include an outsole and a midsole. The outsole can be a unitary piece of relatively high-friction material that provides traction. The midsole can include foam that is disposed between the outsole and the upper for providing cushioned support for the wearer.

In some cases, the article of footwear may not be versatile enough for certain activities. For instance, the midsole may be sufficiently stiff enough to support high impact activities, such as running, but the midsole may be too stiff for walking and/or standing for long periods of time. As such, the footwear may be uncomfortable for certain activities. Also, the midsole may be resilient enough to properly cushion a wearer's feet for long periods of standing; however, the same midsole may be too resilient when pushing off and thrusting the foot forward (e.g., at the start of a sprint). As such, the midsole may deflect too much and excessively absorb the input force from the wearer, thereby reducing the forward thrust of the wearer's foot.

Accordingly, there remains a need for an article of footwear that is more versatile such that the footwear provides adequate support during a wide variety of activities. Also, there remains a need for an article of footwear that can be comfortable enough to wear while walking and standing during long periods of time and that also provides a sufficiently stiff surface for pushing off while thrusting the foot forward.

SUMMARY

Accordingly, despite the improvements of known devices described above, there remains a need for an article of footwear that includes an upper and a sole assembly. The sole assembly is operably coupled to the upper, and the sole assembly defines a base support plane. The sole assembly also includes a cushioning assembly with a first end and a second end. The cushioning assembly includes a first cushioning member and a second cushioning member. The first cushioning member includes a first overlapping surface, and the second cushioning member includes a second overlapping surface. The first and second overlapping surfaces overlap each other over the base support plane and each slopes at a positive acute angle relative to the base support plane. The first cushioning member is thicker than the second cushioning member adjacent the first end of the cushioning assembly, and the second cushioning member is thicker than the first cushioning member adjacent the second end of the cushioning assembly. The first cushioning member has a resistance to resilient deformation that is less than that of the second cushioning member.

An article of footwear that alternately supports a weight load and a thrust load of a wearer is also disclosed. The weight and thrust loads extend along respective vectors generally from a single point on a foot of the wearer. The article of footwear includes an upper and a sole assembly that is operably coupled to the upper. The sole assembly includes an anterior portion and a posterior portion. The sole assembly also defines a base support plane, and the weight load is substantially normal to the base support plane, whereas the thrust load is disposed at an acute angle relative to the base support plane and is oriented away from the anterior portion toward the posterior portion. The sole assembly includes a cushioning assembly with a first cushioning member and a second cushioning member that overlap each other over the base support plane. Each of the first and second cushioning members support both the weight load and the thrust load. The first and second cushioning members each have a thickness that varies across the base support plane, such that the vector of the weight load extends through a first thickness of the second cushioning member and the vector of the thrust load extends through a second thickness of the second cushioning member. The second thickness is greater than the first thickness. Also, the first cushioning member has a resistance to resilient deformation that is less than that of the second cushioning member.

Still further, an article of footwear having an anterior portion, a posterior portion, and a longitudinal axis extending between the anterior and posterior portions is disclosed. The article of footwear includes an upper, an outsole that is operably coupled to the upper, and a midsole that is operably coupled to both the upper and the outsole. The outsole defines a base support plane, and the midsole is disposed between the upper and the outsole. The midsole includes a main portion with an opening and a cushioning assembly disposed within the opening. The cushioning assembly supports a ball of a foot of a wearer. The cushioning assembly includes a first end and a second end that are opposite each other and that are both substantially perpendicular to the longitudinal axis. The first end is disposed adjacent to the anterior portion, and the second end is disposed adjacent to the posterior portion. The cushioning assembly includes a first cushioning member and a second cushioning member. The first and second cushioning members are each substantially wedge shaped and each have a substantially triangular cross-section taken along the longitudinal axis. The first cushioning member includes a substantially flat first overlapping surface, and the second cushioning member includes a substantially flat second overlapping surface. The first and second overlapping surfaces abut each other and overlap each other over the base support plane. Each of the overlapping surfaces slope at a positive acute angle relative to the base support plane and slope away from the base support plane and the anterior portion and toward the upper and the posterior portion. The first cushioning member is thicker than the second cushioning member adjacent the first end of the cushioning assembly, and the second cushioning member is thicker than the first cushioning member adjacent the second end of the cushioning assembly. The second cushioning member is disposed between the first cushioning member and the base support plane. Furthermore, the first cushioning member has a resistance to resilient deformation that is less than that of the second cushioning member.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
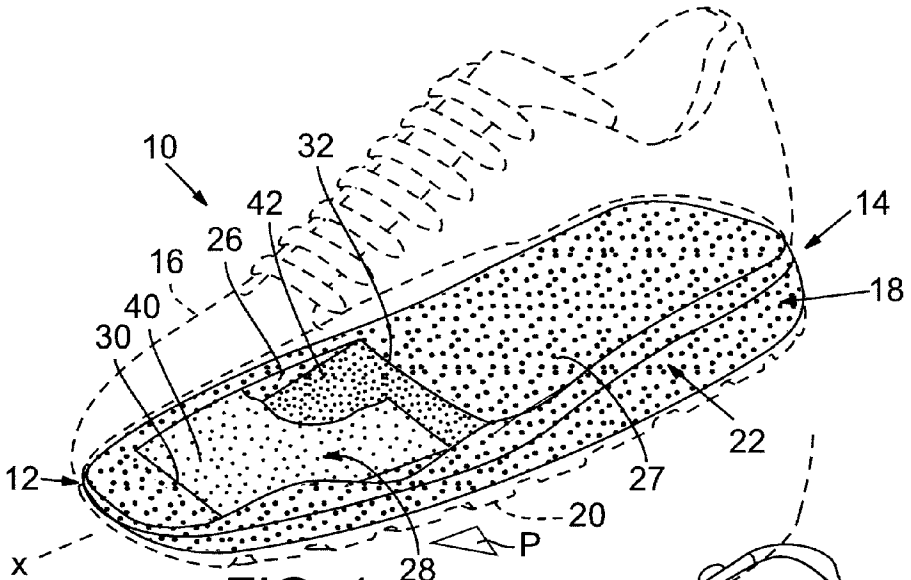
FIG. 1 is a perspective view of an article of footwear with the upper and outsole shown partially in phantom and with the sole assembly shown partially in solid lines.
Figure 2:
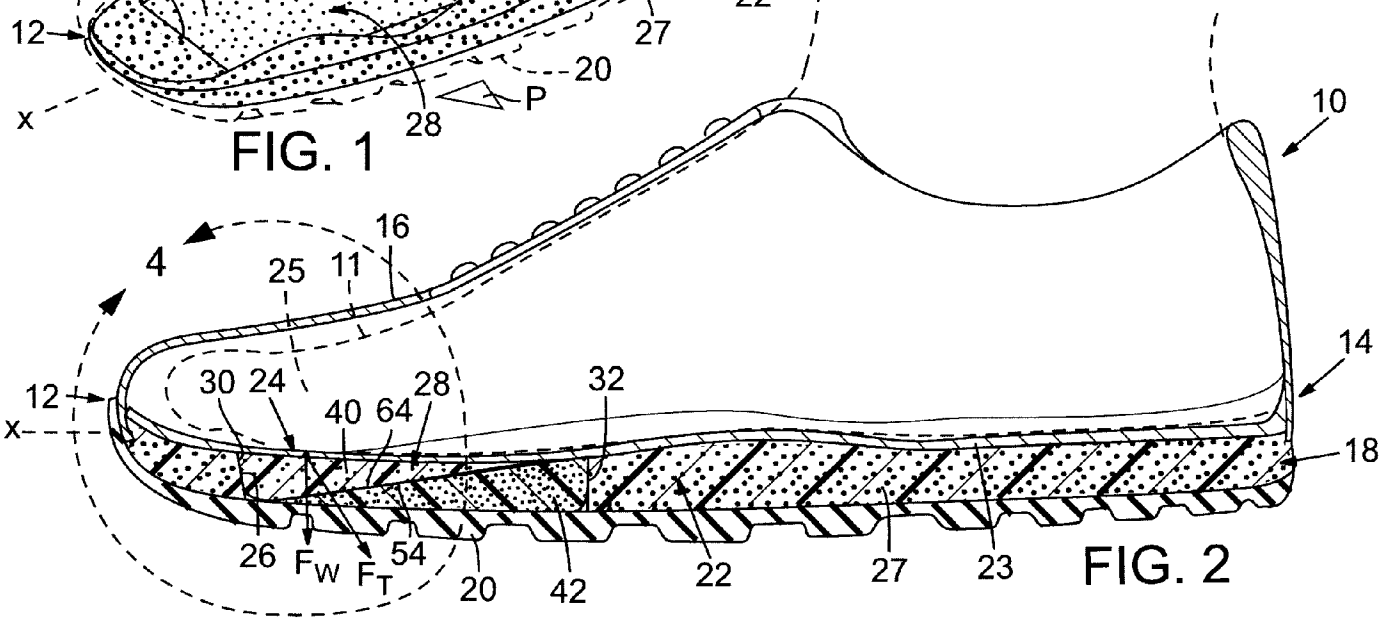
FIG. 2 is a longitudinal cross section of the article of footwear of FIG. 1.
Figure 3:
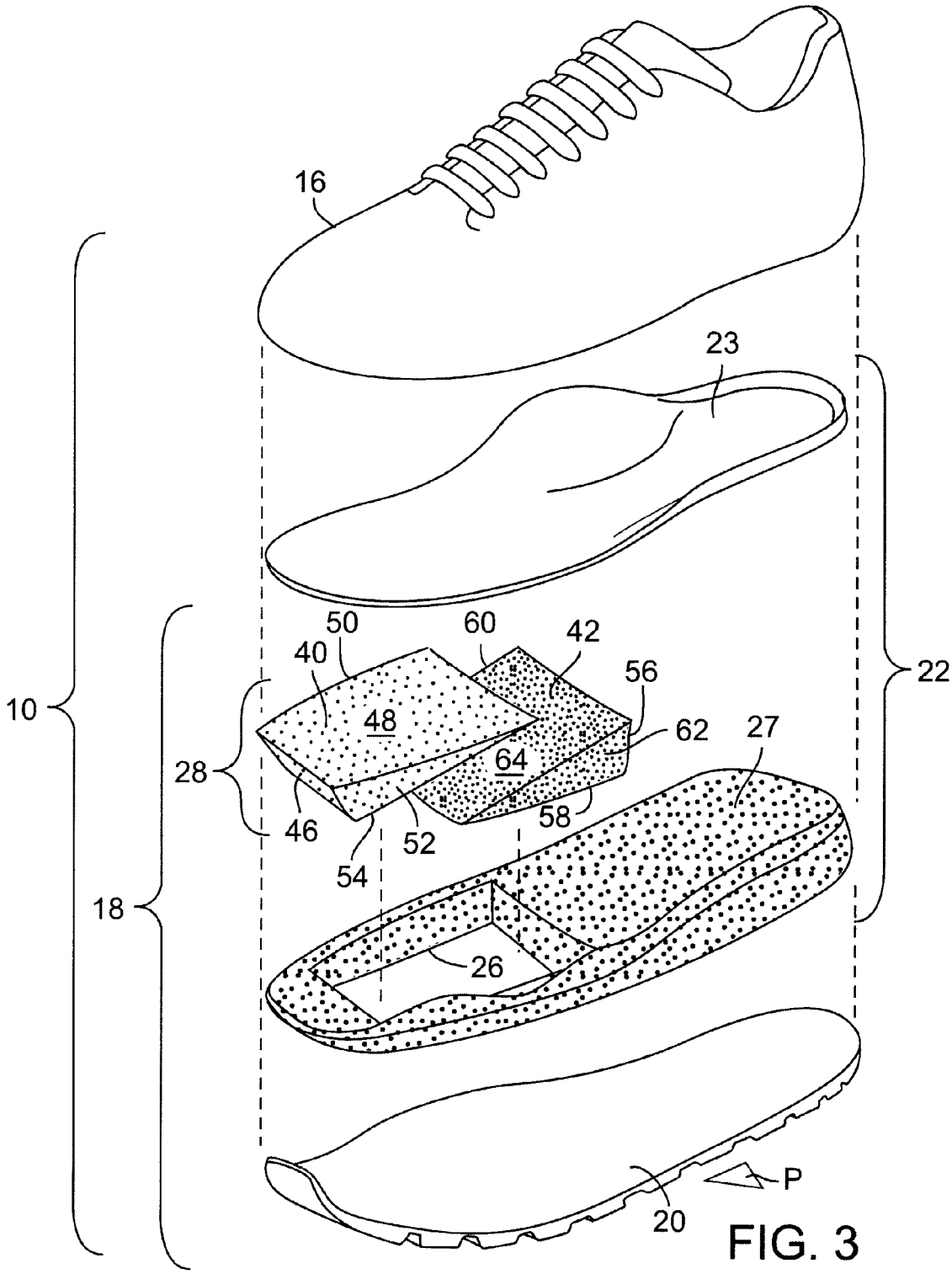
FIG. 3 is an exploded perspective view of the article of footwear of FIG. 1.

Referring to FIGS. 1-3, an article of footwear 10 is illustrated according to various exemplary embodiments of the present disclosure. The article of footwear 10 can fit about and support a foot 11 of a wearer (shown in phantom in FIG. 2). The article of footwear 10 can define an anterior portion 12 and a posterior portion 14. Also, the footwear 10 can have a longitudinal axis X extending between the anterior and posterior portions 12, 14. As shown, the footwear 10 can be a shoe (e.g., an athletic shoe); however, it will be appreciated that the footwear 10 could be of any suitable type other than a shoe, such as a sandal, boot, and the like without departing from the scope of the present disclosure.

As shown in FIG. 3, the article of footwear 10 can include an upper 16. The upper 16 can include one or more panels that are interconnected to define a cavity that receives the foot 11 of the wearer (FIG. 2). Also, the upper 16 can include laces, buckles, pile tape, or other suitable types of means of securing the upper 16 to the foot 11.

In addition, the article footwear 10 can include a sole assembly 18 as shown in detail in FIG. 3. The sole assembly 18 can generally include an outsole 20 and a midsole 22. Both the outsole and midsole 20, 22 can be operably coupled to the upper 16. More specifically, the midsole 22 can be disposed between the outsole 20 and the upper 16. Generally, the outsole 20 can include one or more pieces of high-friction material, such as rubber, and can include various grooves, sipes, or other features for improving traction of the footwear 10. Also, the midsole 22 can include a variety of resiliently deformable and deflectable members for providing cushioned support of the foot 11. In some embodiments, the midsole 22 can be made out of foam, as will be discussed in greater detail below. Moreover, in some embodiments, the midsole 22 can include fluid filled bladders (not shown) for providing cushioned support.

Figure 4:
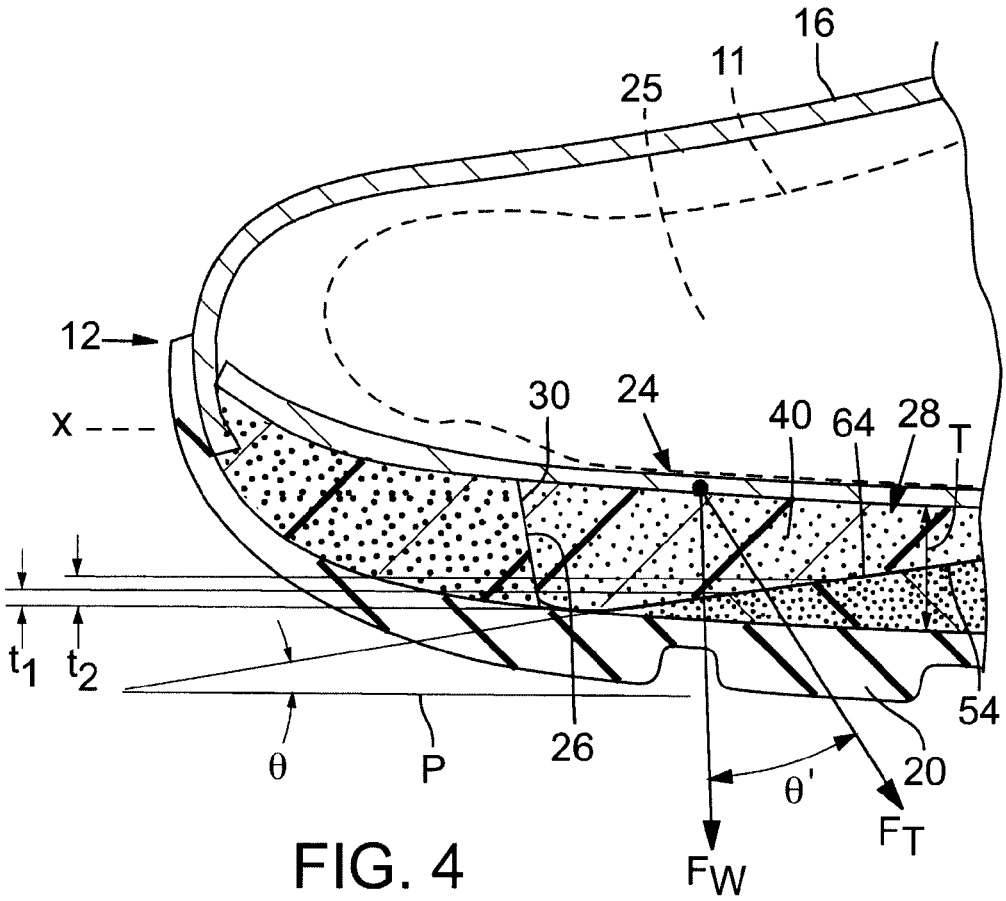
FIG. 4 is a detail view of the article of footwear taken from FIG. 2.

In the embodiments illustrated, the outsole 20 can define a base support plane P (FIGS. 1 and 4). It will be appreciated that the outsole 20 can be substantially flat or slightly curved; however, during use, at least a portion of the outsole 20 can substantially flatten against flat ground, running surface, etc., such that the outsole 20 defines the base support plane P.

Also, the midsole 22 can extend from the anterior portion 12 to the posterior portion 14. The midsole 22 can further define a ball portion 24 that supports a ball portion 25 (i.e., the metatarsals and immediately adjacent areas) of the foot 11 (see FIGS. 2 and 4). As such, the ball portion 25 of the foot 11 (i.e., the portion of the sole of the foot 11 between the toes and the arch of the foot 11) can be adequately supported by the ball portion 25 of the midsole 22.

As shown in FIG. 3, the midsole 22 can include a sock liner 23, which is substantially flat and thin and which substantially conforms to the lower portion of the foot 11 of the wearer. The sock liner 23 can be made out of any suitable material, such as a thin foam material. Also, the midsole 22 can include a main portion 27, as shown in FIG. 3. The main portion 27 can extend over the outsole 20 and can be made out of any suitable material. The main portion 27, for instance, can be made out of a resiliently deformable foam material. Also, as shown in FIG. 3, the main portion 27 can define an opening 26. The opening 26 can be substantially cuboid in shape. The opening 26 can be disposed generally at the ball portion 24 of the midsole 22, so as to be disposed underneath the ball portion 24 of the foot 11 (FIG. 2).

The midsole 22 can also include a cushioning assembly 28 (FIG. 3). The cushioning assembly 28 can include a first end 30 and a second end 32 (FIGS. 1 and 2). The first and second ends 30, 32 can be substantially perpendicular to the longitudinal axis X of the footwear 10. Also, the first and second ends 30, 32 can be opposite each other. The first end 30 can be disposed closer to (adjacent) the anterior portion 12 of the footwear 10 as compared to the posterior portion 14. On the other hand, the second end 32 can be disposed closer to (adjacent) the posterior portion 14 as compared to the anterior portion 12 of the footwear 10. As will be discussed, the cushioning assembly 28 can provide varying types of support for the ball portion 25 of the midsole 22, such that the cushioning assembly 28 can provide a wider variety of support of the ball portion 25 of the wearer's foot 11.

The cushioning assembly 28 will now be described in greater detail. The cushioning assembly 28 can include a first cushioning member 40 and a second cushioning member 42. (It will be appreciated that a portion of the first cushioning member 40 is removed in FIG. 1 for purposes of clarity.) The first and second cushioning members 40, 42 can be made out of any suitable material, such as resiliently deformable foam, and can be formed in any suitable shape, such as respective wedge shapes that overlap each other. Also, as shown in FIGS. 2 and 4, both the first and second cushioning members 40, 42 can taper in thickness between the first and second ends 30, 32 of the cushioning assembly 28. In some embodiments, a collective thickness T (FIG. 4) of the first and second cushioning members 40, 42 is between approximately 8 mm and 10 mm.

Furthermore, the first cushioning member 40 can have a resistance to resilient deformation that is less than that of the second cushioning member 42. For instance, the second cushioning member 42 (the "harder" member) can be made out of denser foam and/or can have a higher durometer as compared to the first cushioning member 40 (the "softer" member). In some embodiments, the first cushioning member 40 can have an Asker durometer that is less than 55, and the second cushioning member 42 can have an Asker durometer that is greater than 55. Furthermore, in some embodiments, the first cushioning member 40 can have an Asker durometer that is between approximately 35 and 45 (e.g., 40), and the second cushioning member 42 can have an Asker durometer that is between approximately 65 and 75 (e.g., 70). As such, the first cushioning member 40 can be more easily resiliently deformed than the second cushioning member 42.

Also, in some embodiments, the main portion 27 of the midsole 22 can have a resistance to resilient deformation greater than that of the first cushioning member 40 and less than that of the second cushioning member 42. For instance, in some embodiments, the main portion 27 can have an Asker durometer between approximately 40 and 50 (e.g., 48). In other embodiments, both the first and second cushioning members 40, 42 can have a higher resistance to resilient deformation than the main portion 27 of the midsole 22. Thus, loads from the foot 11 of the wearer can be distributed and supported differently by the first and second cushioning members 40, 42 and on the main portion 27 of the midsole 22 depending on the wearer's activity, stance, posture etc., as will be discussed in greater detail below.

As mentioned above, the first and second cushioning members 40, 42 can have any suitable shape. For instance, in some embodiments, the first and second cushioning members 40, 42 can each have a wedge shape. In some embodiments, the first cushioning member 40 and/or the second cushioning member 42 can have a cross section (see FIGS. 2 and 4) that is substantially shaped like a right triangle. The width, thickness, and other dimensions of the first and/or second cushioning members 40, 42 can be dependent on the overall size of the footwear 10 and/or the anatomical features of the wearer's foot.

The first cushioning member 40 can include a plurality of substantially flat surfaces. More specifically, as shown in FIG. 3, the first cushioning member 40 can include an anterior surface 46, and superior surface 48, a medial surface 50, a lateral surface 52, and an overlapping surface 54. Each of the surfaces 46, 48, 50, 52, 54 can be substantially flat or can be slightly curved. Also, as shown in FIGS. 2 and 4, the first cushioning member 40 can have a substantially triangular cross-section taken along the longitudinal axis X. Furthermore, the second cushioning member 42 can include a posterior surface 56, an inferior surface 58, a medial surface 60, a lateral surface 62, and an overlapping surface 64. Like the first cushioning member 40, the second cushioning member 42 can have a substantially triangular cross-section taken along the longitudinal axis X. As shown in FIG. 2, the second cushioning member 42 can be disposed between the first cushioning member 40 and the base support plane P.

It will be appreciated that the first and second cushioning members 40, 42 can have any suitable shape other than the wedge shapes shown. Also, it will be appreciated that the first and second cushioning members 40, 42 can be connected to each other (e.g., via adhesives, etc.) and/or to the main portion 27 of the midsole 22. In still other embodiments, the first cushioning member 40 can be made of the same material and/or integrally connected to the main portion 27 of the midsole 22.

As shown in FIG. 4, the overlapping surfaces 54, 64 can be substantially flat and can overlap and abut each other. Also, the overlapping surfaces 54, 64 can be disposed at an acute angle θ relative to the base support plane P. In some embodiments, the angle θ can be between approximately 10° and 45°. Moreover, the overlapping surfaces 54, 64 can slope away from the base support plane P and the anterior portion 12 of the footwear 10. As such, the overlapping surfaces 54, 64 can slope toward the upper 16 and the posterior portion 14 of the footwear 10. Still further, the first cushioning member 40 can be thicker than the second cushioning member 42 adjacent the first end 30 of the cushioning assembly 28. On the other hand, the second cushioning member 42 can be thicker than the first cushioning member 40 adjacent the second end 32 of the cushioning assembly 28.

As such, as shown in FIGS. 2 and 4, the cushioning assembly 28 can distribute and support loads from the foot 11 in varying ways. For instance, the foot 11 can apply a weight load $F_W$ and can alternatively apply a thrust load $F_T$ to the cushioning assembly 28. It will be appreciated that the weight load $F_W$ can substantially represent loads from the wearer when the wearer is standing still, and the thrust load $F_T$ can substantially represent loads from the wearer when the wearer is thrusting the foot forward (e.g., in a running or walking motion).

The vectors of the weight and thrust loads $F_W$, $F_T$ can be directed from substantially the same point, for instance, the ball portion 25 of the foot 11. The weight load can be applied such that the vector of the weight load $F_W$ is directed substantially normal to the base support plane P, and the thrust load $F_T$ can be directed such that the vector of the thrust load $F_T$ is directed at an acute angle θ' relative to the base support plane P (FIG. 4). More specifically, the vector of the thrust load $F_T$ can be directed generally toward the base support plane P and toward the posterior portion 14 of the footwear 10. In some instances, the thrust load $F_T$ can be directed substantially normal to the overlapping surface 64 of the second cushioning member 42.

Because of the shape of the first and second cushioning members 40, 42, the weight load $F_W$ can be directed through a first thickness $t_1$ of the second cushioning member 42, whereas the thrust load $F_T$ can be directed through a second thickness $t_2$ of the second cushioning member 42. The second thickness $t_2$ is greater than the first thickness $t_1$. Thus, the second cushioning member 42 can bear more of the thrust load $F_T$ than the weight load F. As such, when the wearer is applying the weight load $F_W$, the first cushioning member 40 can bear the majority of the weight load F. However, when the wearer is applying the thrust load $F_T$, the first and second cushioning members 40, 42 can more equally bear the thrust load $F_T$.

Also, the thrust load $F_T$ can be directed substantially normal to the overlapping surface 64 of the second cushioning member. Accordingly, the wearer can more directly push off the second cushioning member 42.

Because the second cushioning member 42 is more resistant to resilient deformation than the first cushioning member 40, the cushioning assembly 28 can be more easily deformed when the weight load $F_W$ is applied, and the cushioning assembly 28 can be less stiff for added comfort. However, the cushioning assembly 28 can be more stiff when the thrust load $F_T$ is applied, and the wearer can push off the cushioning assembly 28 more easily for added thrust.

Accordingly, when the wearer is standing still or walking slowly, the foot 11 will apply loads to the cushioning assembly 28, which are more likely to resemble the weight load $F_W$, and the cushioning assembly 28 can be more resiliently deformable and can provide softer cushioning. However, when the wearer pushes off the cushioning assembly 28 to thrust the foot 11 forward, such as during an initial thrust before sprinting, the loads applied to the cushioning assembly 28 are more likely to resemble the thrust load $F_T$, and the cushioning assembly 28 can be stiffer and can push back on the foot 11, such that the wearer can thrust forward more readily. Also, the angle θ (FIG. 4) can be greater such that the stiffer second cushioning member 42 functions similar to a runners starter block. Thus, the footwear 10 can be comfortable for wearing while walking, standing still, etc.; however, the footwear 10 can also provide sufficient stiffness and support for running activities. Accordingly, the footwear 10 can be more versatile and can perform better in a wider variety of activities.

In addition, it will be appreciated that the posterior portion 14 of the footwear 10 may leave the ground while the anterior portion 12 remains on the ground surface during certain activities, such as running. However, even in these situations, the benefits of the cushioning assembly 28 can be achieved because the cushioning assembly 28 is disposed adjacent the anterior portion 12.

Figure 5:
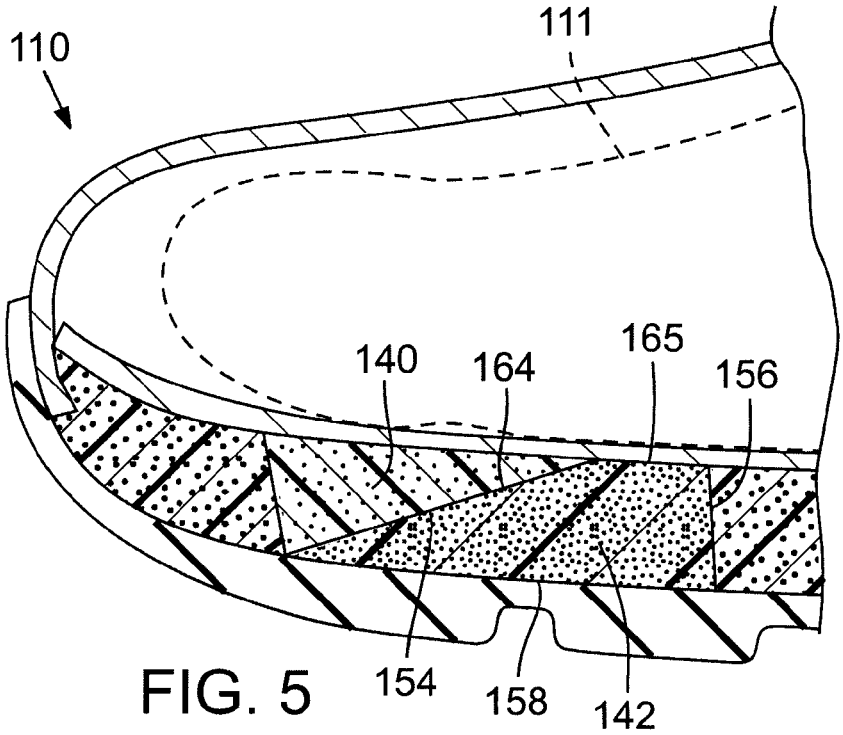
FIG. 5 is a longitudinal cross section of an article of footwear according to various additional exemplary embodiments.

Referring to FIG. 5, another exemplary embodiment of the footwear 110 is illustrated. As shown, the first cushioning member 140 can have a cross sectional shape that is substantially similar to the embodiments of FIGS. 1-4. However, the second cushioning member 142 can have a polygonal cross sectional shape with a substantially trapezoidal shape. Specifically, the second cushioning member 142 can have an inferior surface 158 and a posterior surface 156 that are substantially perpendicular to each other. The second cushioning member 142 can also have an overlapping surface 164 that is overlapped by the overlapping surface 154 of the first cushioning member 140 similar to the embodiments of FIGS. 1-4. The second cushioning member 142 can also include a superior surface 165 that extends between the posterior surface and the overlapping surface 164 as shown. The superior surface 165 can be substantially parallel to the inferior surface 158. The first cushioning member 140 does not overlap the superior surface 165.

As mentioned above, the first and second cushioning members 40, 140, 42, 142 can have any suitable shape, including those embodiments described above and those illustrated in FIGS. 1-5. In other embodiments, the overlapping surfaces 54, 154, 64, 164 can be curved. For instance, one of the overlapping surfaces 54, 154, 64, 164 can be convexly curved in cross section while the corresponding other one of the overlapping surfaces 54, 154, 64, 164 can be concavely curved in cross section such that the overlapping surfaces 54, 154, 64, 164 mate together. Also, in some embodiments, the overlapping surfaces 54, 154, 64, 164 can be convexly curved. These shapes can be adapted according to the anatomical features of the wearer's foot 11, 111. Also, these shapes can be adapted for providing advantageous support for sprinting forward as discussed above.

Moreover, in some embodiments, the cushioning members 40, 140, 42, 142 can be removeable and replaceable with respect to the other portions of the footwear 10, 110. For instance, the wearer can remove and replace one or both of the cushioning members 40, 140, 42, 142 for various reasons (e.g., to change the stiffness or resilience of the cushioning member(s) 40, 140, 42, 142). Accordingly, the footwear 10, 110 can be modular and can be adapted according to the desires of the wearer.

In other embodiments, the shapes of the cushioning members 40, 140, 42, 142 can be adapted for supporting side-to-side (i.e., lateral or transverse movement). For instance, the first and second cushioning members 40, 140, 42, 142 can be tapered in the medial or lateral directions (i.e., the transverse direction). In other words, the orientation of the first and second cushioning members 40, 140, 42, 142 of FIGS. 1-5 can be rotated by ninety degrees in either direction about the longitudinal axis of the wearer's leg. As such, when the wearer's pushes off the ground surface to move laterally (i.e., the thrust force $F_T$ is directed along a transverse vector), the second cushioning member 40, 140, 42, 142 can provide a stiff and hard surface against which to thrust laterally.

It will also be appreciated that the footwear 10, 110 can be modified by including more than two cushioning members 40, 140, 42, 142. For instance, in some embodiments, the footwear 10, 110 can include three or more cushioning members 40, 140, 42, 142. The cushioning members 40, 140, 42, 142 can overlap each other in a manner similar to the embodiments shown in FIGS. 1-5. Also, each of these cushioning members 40, 140, 42, 142 can differ in shape, stiffness, material, or in any other manner.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear having a toe region, a heel region, and a longitudinal axis extending between the toe region and the heel region, the article of footwear comprising:

an upper; and a sole assembly that is operably coupled to the upper, the sole assembly defining a base support plane, the sole assembly also including an anterior portion adjacent the toe region and a posterior portion adjacent the heel region, the sole assembly including a cushioning assembly that extends along the longitudinal axis such that a first end of the cushioning assembly is disposed adjacent the anterior portion and a second end of the cushioning assembly is disposed adjacent the posterior portion, the cushioning assembly including:

a first cushioning member and a second cushioning member, wherein the first cushioning member includes a first overlapping surface, and wherein the second cushioning member includes a second overlapping surface, the first and second overlapping surfaces overlapping each other over the base support plane, wherein the first and second overlapping surfaces each slope at a positive acute angle relative to the base support plane, wherein a first thickness of the first cushioning member decreases along the longitudinal axis in a direction away from the toe region toward the heel region, wherein a second thickness of the second cushioning member increases along the longitudinal axis in the direction away from the toe region toward the heel region, wherein the second cushioning member is stiffer under compression than the first cushioning member.

2. The article of footwear of claim 1, wherein the sole assembly includes a main portion with an opening, the first and second cushioning members being disposed substantially within the opening.

3. The article of footwear of claim 2, wherein the sole assembly includes an outsole and a midsole, the midsole being disposed between the upper and the outsole, the midsole including the main portion, the first cushioning member, and the second cushioning member.

4. The article of footwear of claim 2, wherein the first cushioning member is stiffer under compression than the main portion, and wherein the second cushioning member is stiffer under compression than the main portion.

5. The article of footwear of claim 1, wherein at least one of the first and second cushioning members has a substantially triangular cross section taken along the longitudinal axis of the article of footwear.

6. The article of footwear of claim 1, wherein the first and second ends are substantially perpendicular to the longitudinal axis of the article of footwear.

7. The article of footwear of claim 1, wherein the first and second overlapping surfaces are each substantially flat.

8. The article of footwear of claim 1, wherein the first and second overlapping surfaces abut each other.

9. The article of footwear of claim 1, wherein the first and second cushioning members are disposed in a ball portion of the article of footwear that supports a ball of a foot of a wearer.

10. The article of footwear of claim 1, wherein the first and second overlapping surfaces are substantially planar, and wherein the first and second overlapping surfaces slope away from the base support plane at the toe region toward the upper at the heel region.

11. The article of footwear of claim 1, wherein the second cushioning member is disposed between the first cushioning member and the base support plane.

12. An article of footwear that has a toe region, a heel region, and a longitudinal axis extending between the toe region and the heel region, the article of footwear configured to alternately support a weight load and a thrust load of a wearer, the weight and thrust loads extending along respective vectors generally from a single point on a foot of the wearer, the article of footwear comprising:

an upper; and a sole assembly that is operably coupled to the upper, the sole assembly including an anterior portion adjacent the toe region and a posterior portion adjacent the heel region, the sole assembly defining a base support plane, the vector of the weight load being substantially normal to the base support plane, the vector of the thrust load being disposed at an acute angle relative to the base support plane, the vector of the thrust load being oriented along the longitudinal axis and away from the anterior portion toward the posterior portion, the sole assembly including a cushioning assembly, the cushioning assembly including:

a first cushioning member and a second cushioning member that overlap each other over the base support plane, wherein each of the first and second cushioning members is configured to support both the weight load and the thrust load, wherein the first and second cushioning members each have a thickness that varies along the longitudinal axis such that the thickness of the first cushioning member decreases along the longitudinal axis in a direction away from the toe region toward the heel region and such that the thickness of the second cushioning member increases along the longitudinal axis in the direction away from the toe region toward the heel region, wherein a vector of the weight load extends through a first thickness of the second cushioning member and the vector of the thrust load extends through a second thickness of the second cushioning member, the second thickness being greater than the first thickness, wherein the second cushioning member is stiffer under compression than the first cushioning member, wherein the first cushioning member includes a first overlapping surface, wherein the second cushioning member includes a second overlapping surface, the first and second overlapping surfaces overlapping each other over the base support plane and each sloping at a positive acute angle relative to the base support plane.

13. The article of footwear of claim 12, wherein the first cushioning member includes a first overlapping surface, wherein the second cushioning member includes a second overlapping surface, the first and second overlapping surfaces overlapping each other over the base support plane and each sloping relative to the base support plane.

14. The article of footwear of claim 13, wherein the cushioning assembly extends along the longitudinal axis such that a first end of the cushioning assembly is disposed adjacent the anterior portion and a second end of the cushioning assembly is disposed adjacent the posterior portion, the first cushioning member being thicker than the second cushioning member adjacent the first end of the cushioning assembly, the second cushioning member being thicker than the first cushioning member adjacent the second end of the cushioning assembly.

15. The article of footwear of claim 14, wherein the first and second ends are substantially perpendicular to the longitudinal axis of the article of footwear.

16. The article of footwear of claim 13, wherein the first and second overlapping surfaces are each substantially flat.

17. The article of footwear of claim 12, wherein the first and second overlapping surfaces abut each other.

18. The article of footwear of claim 12, wherein the sole assembly includes a main portion with an opening, the first and second cushioning members being disposed substantially within the opening.

19. The article of footwear of claim 18, wherein the sole assembly includes an outsole and a midsole, the midsole being disposed between the upper and the outsole, the midsole including the main portion, the first cushioning member, and the second cushioning member.

20. The article of footwear of claim 18, wherein the first cushioning member is stiffer under compression than the main portion, and wherein the second cushioning member is stiffer under compression than the main portion.

21. The article of footwear of claim 12, wherein both the first and second cushioning members have a substantially triangular cross section taken along the longitudinal axis of the article of footwear.

22. An article of footwear having an anterior portion configured to be adjacent a plurality of toes of a wearer, a posterior portion configured to be adjacent a heel of the wearer, and a longitudinal axis extending between the anterior and posterior portions, the article of footwear comprising:

an upper;

an outsole that is operably coupled to the upper, the outsole defining a base support plane; and a midsole that is operably coupled to both the upper and the outsole and that is disposed between the upper and the outsole, the midsole including a main portion with an opening and a cushioning assembly disposed within the opening, the cushioning assembly configured to support a ball of a foot of the wearer, the cushioning assembly including a first end and a second end that are opposite each other and that are both substantially perpendicular to the longitudinal axis, the first end disposed adjacent the anterior portion and the second end disposed adjacent the posterior portion, the cushioning assembly including:

a first cushioning member and a second cushioning member, the first and second cushioning members each being substantially wedge-shaped and each having a substantially triangular cross section taken along the longitudinal axis, wherein a thickness of the first cushioning member decreases along the longitudinal axis in a direction away from the anterior portion toward the posterior portion and such that the thickness of the second cushioning member increases along the longitudinal axis in the direction away from the anterior portion toward the posterior portion, wherein the first cushioning member includes a substantially flat first overlapping surface, wherein the second cushioning member includes a substantially flat second overlapping surface, the first and second overlapping surfaces abutting each other and overlapping each other over the base support plane, the first and second overlapping surfaces each sloping at a positive acute angle relative to the base support plane, wherein the first and second overlapping surfaces slope away from the base support plane at the anterior portion toward the upper at the posterior portion, wherein the first cushioning member is thicker than the second cushioning member adjacent the first end of the cushioning assembly, wherein the second cushioning member is thicker than the first cushioning member adjacent the second end of the cushioning assembly, wherein the second cushioning member is disposed between the first cushioning member and the base support plane, and wherein the second cushioning member is stiffer under compression than the first cushioning member.

* * * * *